US006752870B1

(12) United States Patent
Tanokuchi et al.

(10) Patent No.: US 6,752,870 B1
(45) Date of Patent: Jun. 22, 2004

(54) GAS WIPING APPARATUS AND METHOD

(75) Inventors: Ichiro Tanokuchi, Okayama (JP); Sachihiro Iida, Tokyo (JP)

(73) Assignee: JFE Steel Corporation (JP)

( * ) Notice: Subject to any disclaimer, the term of this patent is extended or adjusted under 35 U.S.C. 154(b) by 288 days.

(21) Appl. No.: 09/628,405

(22) Filed: Aug. 1, 2000

(30) Foreign Application Priority Data

Aug. 6, 1999 (JP) ..... 11-224081

(51) Int. Cl.[7] ..... B05C 13/02
(52) U.S. Cl. ..... 118/63; 118/68
(58) Field of Search ..... 118/63, 68, 419; 15/300.1, 306.1; 427/348, 349, 433

(56) References Cited

U.S. PATENT DOCUMENTS 3,525,116 A 8/1970 Shaffer
6,376,020 B1 * 4/2002 Tu ..... 118/63

FOREIGN PATENT DOCUMENTS

| | | |
|---|---|---|
| JP | 57210966 | 12/1982 |
| JP | 1-208441 | * 8/1989 |
| JP | 01 208441 | 9/1989 |
| JP | 09 287752 | 12/1991 |
| WO | 98 53112 | 11/1998 |

* cited by examiner

*Primary Examiner*—Brenda A. Lamb
(74) *Attorney, Agent, or Firm*—Piper Rudnick LLP

(57) ABSTRACT

Gas wiping apparatus and method can reliably prevent edge overcoat and splash, and has face gas wiping nozzles extending widthwise of a strip material, a pair of baffle plates spaced from an edge of the strip material, an edge wiping nozzle disposed between baffle plates at its inner edge and adjacent the strip material edge, all with critical spacing relative to each other.

6 Claims, 5 Drawing Sheets

GAS WIPING APPARATUS AND METHOD

BACKGROUND OF THE INVENTION

1. Field of the Invention

The present invention relates to apparatus and method for removing excess molten metal from a metallic strip by means of gas wiping after the strip has been lifted out of a bath used for plating the strip with molten metal.

The invention relates to plating of various metals, including but not limited to zinc, 5% Al zinc, 55% Al zinc and 100% aluminum, for example.

2. Description of the Related Art

In a continuous molten zinc plating line, for example, in which a steel strip is plated with zinc, excess molten zinc on the front and back surfaces of a steel strip is wiped away by jetting a gas from wiping nozzles onto the front and back surfaces of the steel strip. Reference is made to FIG. 8 of the accompanying drawings, wherein the steel strip is identified as "a" and the wiping nozzles are "b". In this manner, the amount of pickup of zinc to be plated on the steel strip is limited. This controls the excess molten zinc carried up from the bath, on the front and back surfaces of the steel strip a, when the strip is lifted from the molten zinc bath. However, such pickup control is confronted by the problem that the gas, having jetted from the wiping nozzles b, escapes outwardly of the steel strip a on its two side edges, causing so-called edge overcoat in which the zinc adheres in an excess amount to each edge of the steel strip a.

To cope with this edge overcoat problem, the present assignee Kawasaki Steel Corporation has previously proposed a gas wiping apparatus as disclosed in Japanese Unexamined Patent Application Publication No. 1-208441.

This prior wiping apparatus is constituted, as viewed in FIG. 9 of the drawings herewith, of wiping nozzles b of the aforesaid type; a pair of baffle plates c extending widthwise of the upwardly moving steel strip a and at a height covering a gas impingement point A, where gases jetted from the wiping nozzles L are caused to impinge on both the front and back surfaces of the steel strip a; and an edge wiping nozzle e disposed between each such baffle plate c at its inner edge and the steel strip a at its outer edge, as shown. The edge wiping nozzle c is provided with a gas jet d aimed downstream on the steel strip a of the gas impinging point A and in the direction of travel of the steel strip a. The edge wiping nozzle c is operated to direct a jet toward the widthwise direction on the steel strip a, the jet being caused to travel upstream and in parallel with the widthwise marginal edge of the steel strip a. By the arrangement of the baffle plate c, the two opposed gas streams jetted from the wiping nozzles a, aimed at both the front and back faces of the steel strip a, are prevented from interfering with each other at the position outwardly of the two side edges of the steel strip a. This prevents edge overcoat. Moreover, a gas jetted from the edge wiping nozzle d is aimed such that fine molten metal that is produced during wiping, which fine metal is called "splash," is prevented from adhering to and depositing on and further growing on the baffle plate c located adjacent to the edge of the steel strip a, and molten metal is prevented from growing in bridge-like form between the baffle plate c and the edge of the steel strip a.

However, such conventional gas wiping apparatus has the drawback that it fails to adequately prevent edge overcoat and splash, depending upon the positioning of both the baffle plate and the edge wiping nozzle.

SUMMARY OF THE INVENTION

Accordingly, it is one object of the present invention to provide a gas wiping apparatus and method which is capable of preventing edge overcoat and splash with reliability.

We have examined various different ways of positioning a baffle plate and an edge wiping nozzle, and have discovered surprising phenomena.

As shown in FIG. 3 of the drawings, which shows only one of the two edges of the sheet 9, the distance between the gas jet port opening 71 of an edge wiping nozzle 7 and the gas impingement point A of face-wiping nozzles 2, 2' may be designated L (mm), and the clearance between the outer edge 91 of the steel sheet and the inner edge 61 of a baffle plate 6 is designated C (mm). These distances and clearance can be accurately adjusted by the apparatus of this invention, as will further be described in detail hereinafter. We have newly discovered that a significant interaction is presented between L and C, which interaction is surprising and totally unexpected.

Namely, we have discovered that the optimum range of L is variable with the value of C. To sum up generally, L should become larger as C becomes smaller, whereas L should become smaller as C becomes larger.

The significance of the optimum range of C will now be explained. With regard to the baffle plate 6, it has been found that a C value of less than 4 mm causes splash to adhere to and deposit on the baffle plate 6 so that the molten metal is frequently apt to grow in bridge-like form between the edge of the steel strip 9 and the baffle plate 6. It has also been found that if C is more than 7 mm, the ratio of the edge spray pressure of the face spray pressure becomes too low, even if a powerful jet pressure-edge wiping nozzle is used. In this instance, molten metal cannot be sufficiently wiped away at the edges 91 of the steel strip, with consequent failure to prevent heavy edge overcoat. In addition, in some cases, splash adheres to and deposits on the baffle plate, even though the edges 91 of the steel sheet are spaced from their baffle plates 6.

Moreover, we have found that the spacing L is dependent upon the spacing C. In FIG. 4, there are shown the optimum interrelated ranges of L and C which we have discovered to be necessary to prevent edge overcoat and splash.

Note should be taken of the minimum value of L. When C is small, the minimum value of L should be large; otherwise the apparatus is incapable of preventing splash. For instance, when C is 7 mm, the minimum value of L must be 6 mm, and when C is 4 mm, the minimum value of L must be 12 mm. If L is maintained at 6 mm with C set at 4 mm, the drawback is encountered that splash re-adheres to and is deposited on the edge wiping nozzle, adhering once again to the widthwise marginal edge of the steel strip when the splash reaches a certain thickness. The drawback noted here cannot be overcome even when all possible adjustments are made to the gas jet quantities and gas pressures of the nozzle 7.

On the other hand, we have found that there is a maximum value of L. When C is large, the maximum value of L must be correspondingly small in order to prevent splash. For example, when C is 4 mm, the maximum value of L is 35 mm, and when C is 7 mm, the maximum value of L is 27.5 mm. If L is maintained at 35 mm with C set at 7 mm, the drawback arises that edge wiping becomes less effective so that splash occurring during wiping adheres to and deposits on the baffle plate and further grows thereon, or molten metal grows in bridge-like form between the baffle plate 6

(FIG. 3) and the edge 91 of the steel strip. Such drawback cannot be overcome, even when all possible adjustments are made to the gas jet quantities and gas pressures of the edge wiping nozzle 7.

With these surprising findings in mind, we have conducted further intensive researches and have discovered the important relationship between the clearance C (mm) and the distance L (mm) which enables edge overcoat and splash to be satisfactorily prevented. Thus, this invention has been made.

More specifically, the present invention provides a gas wiping apparatus and method wherein a plurality of face gas wiping nozzles extend widthwise of a strip material that is continuously conveyed upwardly from a liquid bath. The face gas wiping nozzles are aimed to direct jets of gases onto the front and back faces of the strip material, thereby limiting and controlling the pickup of the liquid deposited on the front and back surfaces of the strip material;

a pair of baffle plates disposed at a position extending from an edge of the strip material and at a location adjacent to the face gas impinging area on the faces of the strip material; and an edge wiping nozzle disposed between the baffle plates at their inner edges and the edge of the strip material, the edge wiping nozzle being provided with a gas jet port positioned downward of the gas impinging point and in the direction of travel of the strip material, the edge wiping nozzle being operated to jet a gas toward the strip material traveling upstream and substantially parallel with the marginal edge of the strip material;

wherein a clearance C (mm) between the marginal edge of the strip material and the inner edge of the baffle plates is controlled within the range from 4 to 7 mm; and when the distance between the gas jet opening of the edge wiping nozzle and the face gas impingement area is expressed as L (mm), the relationship between the distance L and the clearance C satisfies the following equation:

$$-2.0C+20 \leq L \leq -2.5C+45.$$

DESCRIPTION OF THE PREFERRED EMBODIMENTS

Figure 1:
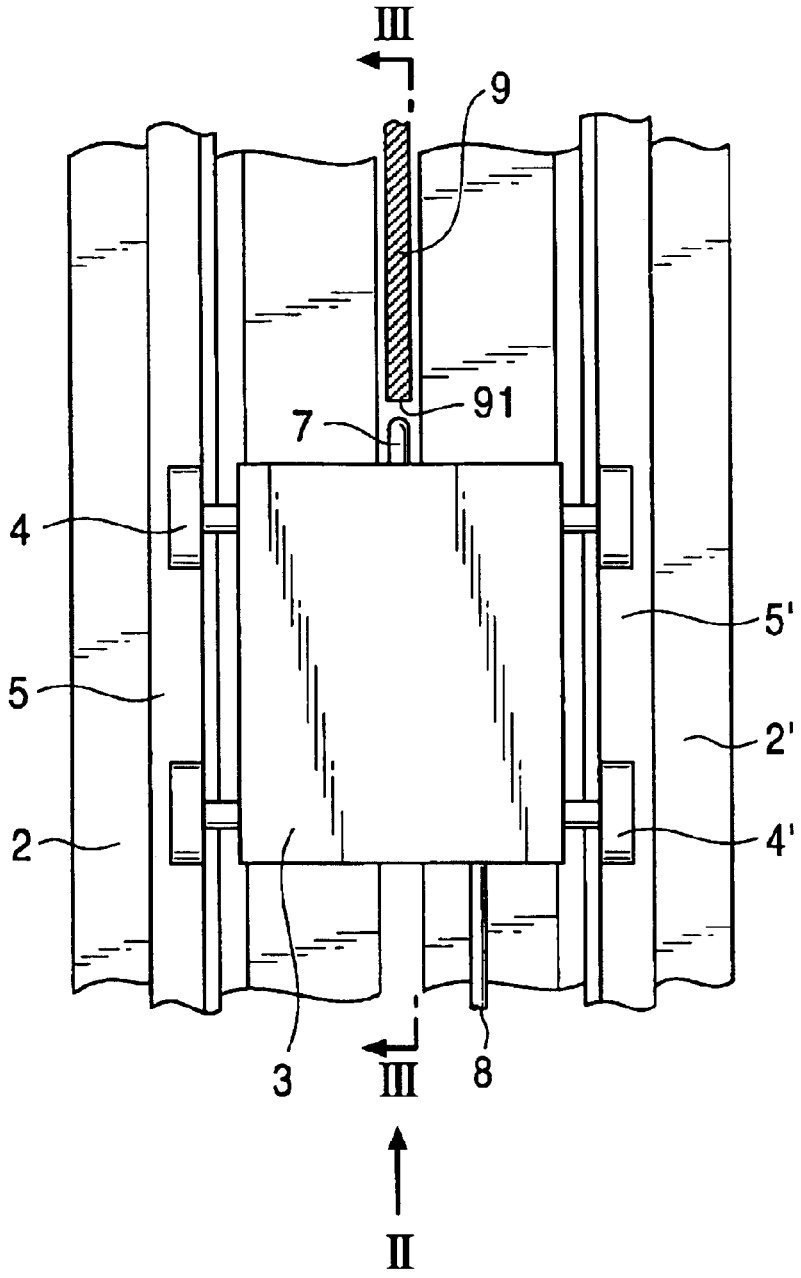
FIG. 1 is a schematic plan view explanatory of one embodiment of the gas wiping apparatus and method according to the present invention. It is fragmentary, showing the apparatus at only one edge of the steel strip 9; it will be understood that the complete apparatus includes corresponding elements at the other edge of the steel strip 9.
Figure 2:
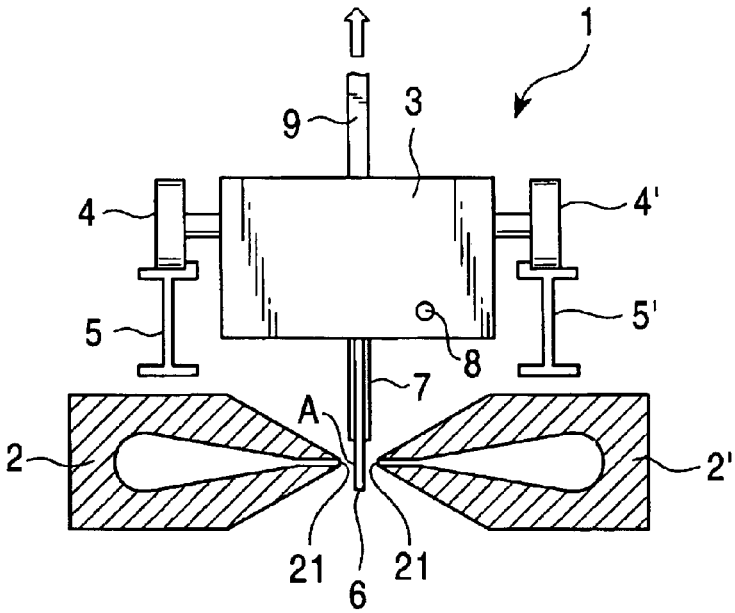
FIG. 2 is a view, in exploded mode, of face-wiping nozzles and an edge-wiping nozzle according to this invention, taken along the arrow II of FIG. 1.

One preferred embodiment of the present invention is described with reference to the drawings. Its specific structures and method steps are not intended to define or to limit the scope of the invention. FIG. 1 is a schematic plan view illustrating one embodiment of the gas wiping apparatus and method according to the present invention; FIG. 2 is a view, as exploded, of face-wiping nozzles and an edge-wiping nozzle taken along the arrow II of FIG. 1; and FIG. 3 is a sectional view taken along the line III—III of FIG. 1.

Figure 3:
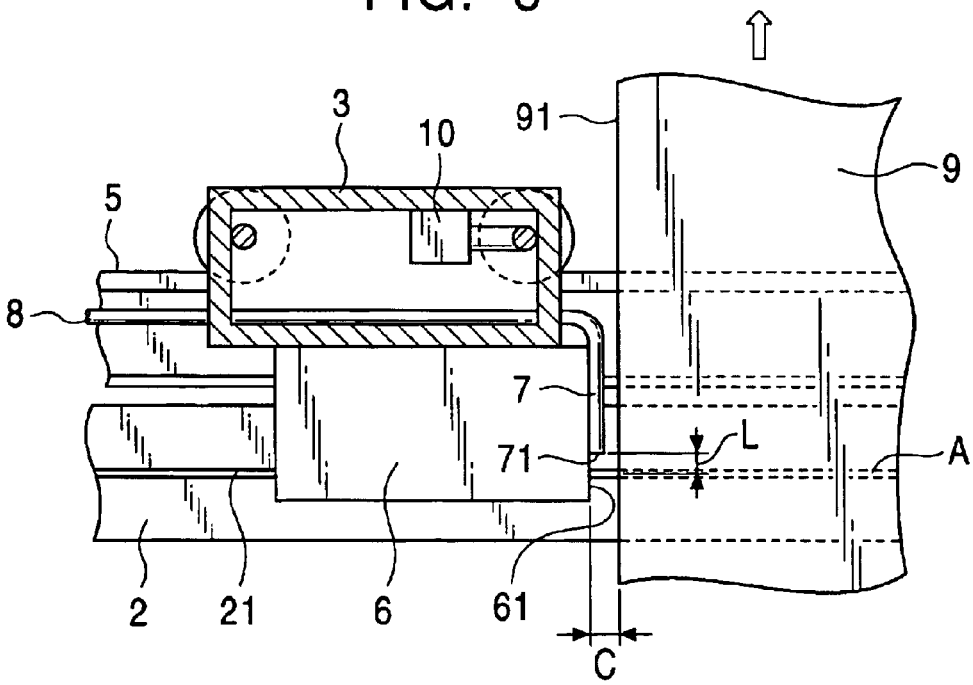
FIG. 3 is a fragmentary sectional view taken along the line III—III of FIG. 1, showing only one edge 91 of the steel sheet, with the understanding that similar apparatus and method is also applied to the other edge of the sheet.

Reference is now made to FIGS. 1 to 3. Face-wiping nozzles 2 and 2' are disposed adjacent to and aimed at the front and back face surfaces of a metal strip 9, which is being pulled up continuously from a molten metal bath (of molten zinc or the like, for example) and caused to travel upwardly and continuously as shown by the arrow in FIG. 2. These face-wiping nozzles extend along the width of the steel strip 9. The face-wiping nozzles 2 and 2' are each provided with elongated slit-type gas jet ports 21 and 21' (FIGS. 2 and 3) of a slit shape, from which gases are jetted in slit form toward the front and back surfaces of the steel strip 9, often at a constant pressure (1 kg/cm$^2$ or below in this embodiment). Thus, excess molten metal picked up from the bath on the front and back surfaces of the steel strip 9 is wiped away to limit the amount of molten metal carried by the front and back surfaces, as desired.

The edge-wiping nozzles 7, 7 are positioned outwardly of the edges 91, 91 of the steel strip 9. Adjustable positioning permits wiping of steel strips having varying widths (usually from 500 to 1,550 mm) with no need for replacement of the wiping nozzles 2 and 2'.

I-beams 5 and 5' extend outside of and parallel to the steel strip 9. They are arranged to carry wheels 4 and 4' which support a truck 3 and are caused to roll on the beams 5 and 5' so that the truck 3 and its edge-wiping jet 7 is adjustable toward and away from the adjacent edge of the steel strip 9. The movement of the truck 3 and its cargo is effected with use of drive means 10, for example, a motor mounted on the truck 3, and by clockwise or counterclockwise rotation of the wheels 4 and 4'.

One or two baffle plates 6 (FIG. 3) are fixedly attached to the truck 3 for movement back and forth toward and away from the adjacent edge 91 of the sheet 9. The baffle plates 6 are positioned to prevent gas jets from the wiping nozzles 2 and 2' from interfering with each other outwardly of the edges of the steel strip 9. Hence, the gas jets are constrained to prevent edge overcoat by carefully adjusting the positions of the baffle plates 6 relative to the adjacent edge of the strip.

In the course of gas wiping, each baffle plate 6 is situated at a position laterally spaced apart from the edge 91 of the steel strip 9, as it moves through the gas wiper, and at a height spaced from, the jet impingement point A where the gases jetted from the face-wiping nozzles 2 and 2' are caused to impinge on the front and back surfaces of the steel strip 9.

In the case where the baffle plate 6 has too long a lower end portion with respect to the steel strip 9 traveling upstream, adverse splash tends to adhere to the steel strip 9. Preferably, therefore, the lower end of the baffle plate 6 should be at a distance from 5 to 20 mm from the face-gas impinging area A. In this instance, the gases jetted from the face-wiping nozzles 2 and 2' can be reliably prevented from mutual interference with each other.

An edge wiping nozzle 7 (FIGS. 1, 2 and 3) is disposed between the baffle plate 6 at its inner edge 61 (FIG. 3) and each edge 91 of steel strip 9. The edge-wiping nozzle 7 is provided with a gas jet opening 71 positioned spaced along the steel strip 9 from the face gas impinging area A, and in the direction of travel of the steel strip 9. Each edge wiping nozzle 7 is aimed substantially parallel to the adjacent edge 91 of the corresponding steel strip 9 so that the jet from the gas jet 71 is directed onto the edge of the steel strip 9. The jet 71 is controlled at a present pressure (2 kg/cm$^2$ or below in this embodiment). Gas supply to the edge wiping nozzle 7 is introduced through a gas pipe 8 connected to the edge wiping nozzle 7 (FIG. 3).

Consequently the jet from the edge wiping nozzle 7 is greatly capable of reducing splash that would otherwise fly widthwise of and outwardly of the steel strip 9. This prevents splash from adhering to the baffle plate 6, the edge wiping nozzle 7 and the like, and also prevents molten metal from growing in a bridge-like form between the baffle plate 6 and the edge 91 of the adjacent steel strip 9.

The direction of gas jetting from either edge wiping nozzle 7 can be aimed to a slight extent, either toward the adjacent steel strip 9, or conversely toward the baffle plate 6. Though the wiping ability at the edges 91 of the steel strip 9 is apt to be strong in the former case and weak in the latter case, gas jetting conditions may be made optimum in either such case by increasing or decreasing the gas quantities or gas pressures jetted from the edge wiping nozzle 7.

In the FIGS. 1–3 embodiment now described, each edge wiping nozzle 7 is firmly secured to the inner end 61 of the baffle plate 6 such that the edge wiping nozzle 7 moves simultaneously with the baffle plate 6 for adjustment in the widthwise direction of the steel strip 9. This is not a limiting feature of the present invention. The edge wiping nozzle 7 and the baffle plate 6 may be separated from each other to move individually or cooperatively for adjustment along the widthwise direction of the steel strip 9.

The adjustment of the baffle plate 6 and the edge wiping nozzle 7 along the widthwise direction of the steel strip 9 is effected when initial positioning of the steel strip 9 is undertaken, depending upon the width of the steel strip 9.

The steel strip 9 sometimes travels along a zigzag path in the widthwise direction during molten metal plating, and hence, the baffle plate 6 and the edge wiping nozzle 7 also follow such zigzag path. In this embodiment, control means (not shown) is provided for controlling the drive means 10 such that the clearance C (mm) is held constant between the edge 91 of the steel strip 9 and the inner edge 61 of the baffle plate 6. The controller is connected to maintain the jet nozzles such that they are spaced from the adjacent edge of the metal strip at a distance C which is 4 to 7 mm and maintain the relationship between distances L and C such that they satisfy the following equation: $-2.0C+20 \leqq L \leqq -2.5C+45$.

In this embodiment, the clearance C (mm) between the edge 91 of the steel strip 9 and the inner edge 61 of the baffle plate 6 is set within the range from 4 to 7 mm, and the relationship between the clearance C and the length L (mm) between the gas jetting port 71 of the edge wiping nozzle 7 and the gas impinging point A is set to meet the following equation (1). These two parameters ensure that edge overcoat can be prevented by the baffle plate 6 and splash by the edge wiping nozzle 7 working together.

Figure 4:
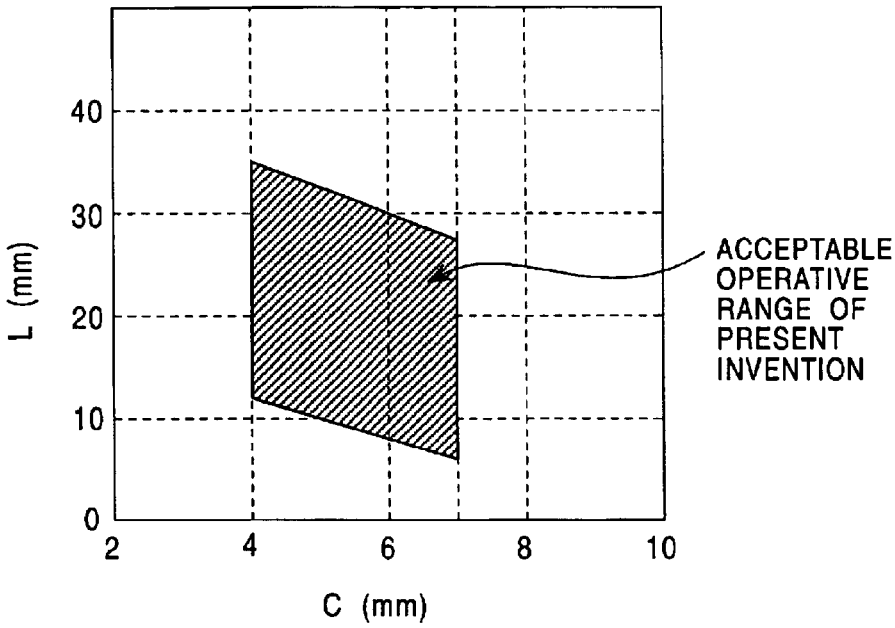
FIG. 4 is a graphical representation of the relationship between the distance L and the clearance C which prevents edge overcoat and splash with reliability.

FIG. 4 is a graph showing the relationship between the clearance C and the length L, as expressed by the formula (1):

$$-2.0C+20 \leqq L \leqq -2.5C+45 \quad (1)$$

The present invention is further described with reference to the data of Table 1, as follows:

TABLE 1

| | No. | C (mm) | L (mm) | Travel speed of steel strip (m/min) | Pressure of wiping gas (kg/cm$^2$) | Pickup of zinc on steel strip on one surface (g/cm$^2$) | Pressure of edge wiping gas (kg/cm$^2$) | Unfavorable adherence and deposition of splash | Ratio of edge overcoat P (%) | Evaluation |
|---|---|---|---|---|---|---|---|---|---|---|
| Comparative Example | 1 | 3 | 10 | 80 | 0.45 | 45 | 1.0 | yes | 3 | bad |
| Comparative Example | 2 | 3 | 20 | 90 | 0.50 | 45 | 1.0 | yes | 4 | bad |
| Comparative Example | 3 | 3 | 30 | 90 | 0.25 | 60 | 1.0 | yes | 3 | bad |
| Comparative Example | 4 | 4 | 10 | 85 | 0.50 | 45 | 1.0 | yes | 4 | bad |
| Present Embodiment | 5 | 4 | 15 | 80 | 0.45 | 46 | 1.0 | no | 5 | good |
| Present Embodiment | 6 | 4 | 20 | 90 | 0.50 | 47 | 1.0 | no | 4 | good |
| Present Embodiment | 7 | 4 | 20 | 90 | 0.35 | 65 | 1.0 | no | 4 | good |
| Present Embodiment | 8 | 4 | 30 | 115 | 0.60 | 44 | 1.0 | no | 3 | good |
| Present Embodiment | 9 | 4 | 30 | 95 | 0.50 | 45 | 1.0 | no | 3 | good |
| Comparative Example | 10 | 4 | 40 | 100 | 0.40 | 50 | 1.0 | yes | 7 | bad |
| Comparative Example | 11 | 4 | 40 | 100 | 0.33 | 60 | 2.0 | yes | 8 | bad |
| Comparative Example | 12 | 7 | 5 | 90 | 0.45 | 45 | 1.0 | yes | 3 | bad |
| Comparative Example | 13 | 7 | 5 | 90 | 0.50 | 40 | 1.0 | yes | 5 | bad |
| Present Embodiment | 14 | 7 | 8 | 95 | 0.85 | 35 | 1.0 | no | 5 | good |
| Present Embodiment | 15 | 7 | 8 | 95 | 0.55 | 40 | 1.0 | no | 4 | good |
| Present Embodiment | 16 | 7 | 15 | 90 | 0.35 | 60 | 1.0 | no | 4 | good |
| Present Embodiment | 17 | 7 | 15 | 90 | 0.37 | 55 | 1.0 | no | 3 | good |
| Present Embodiment | 18 | 7 | 25 | 100 | 0.40 | 60 | 1.0 | no | 4 | good |
| Present Embodiment | 19 | 7 | 25 | 100 | 0.55 | 45 | 1.0 | no | 5 | good |
| Comparative Example | 20 | 7 | 30 | 95 | 0.50 | 42 | 1.0 | yes | 9 | bad |
| Comparative Example | 21 | 7 | 30 | 95 | 0.70 | 37 | 1.0 | yes | 8 | bad |
| Comparative Example | 22 | 9 | 10 | 90 | 0.85 | 30 | 1.0 | no | 8 | bad |
| Comparative Example | 23 | 9 | 20 | 90 | 0.60 | 40 | 1.0 | no | 9 | bad |

TABLE 1-continued

| | No. | C (mm) | L (mm) | Travel speed of steel strip (m/min) | Pressure of wiping gas (kg/cm$^2$) | Pickup of zinc on steel strip on one surface (g/cm$^2$) | Pressure of edge wiping gas (kg/cm$^2$) | Unfavorable adherence and deposition of splash | Ratio of edge overcoat P (%) | Evaluation |
|---|---|---|---|---|---|---|---|---|---|---|
| Comparative Example | 24 | 9 | 30 | 90 | 0.60 | 42 | 1.0 | no | 10 | bad |
| Comparative Example | 25 | 9 | 30 | 95 | 0.60 | 42 | 2.0 | no | 9 | bad |
| Comparative Example | 26 | 9 | 30 | 95 | 0.65 | 40 | 3.0 | yes | 8 | bad |

In Table 1, Nos. 1 to 4, 10 to 13 and 20 to 26 are Comparative Examples outside the scope of the formula (1). Examples Nos. 5 to 9 and Nos. 14 to 19 are Present Embodiments which are inside the scope of the formula (1). In both the Comparative Examples and the Present Embodiments, the width of a steel strip 9 was 900 mm, the substance of a plating was 45 g/m$^2$, the dimension of the baffle plate 6 was 20 mm in upper and lower widths and 600 mm in length, and the internal diameter of an edge wiping nozzle 7 was 3 mm.

Comparative Examples 1 to 3 had a clearance C of 3 mm, and each such example prevented edge overcoat on the steel strip 9. But these examples suffered splash deposited on the baffle plate 6 and zinc frequently grew between the baffle plate 6 and the edge 91 of the steel strip 9, interfering with continued stable operation.

Figure 5:
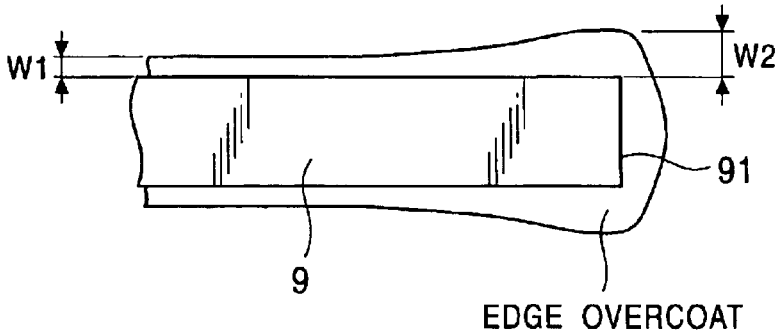
FIG. 5 is a view explanatory of the ratios of edge overcoat.

Here, the amount of edge overcoat was determined by the ratio of pickup W1 adhered to the face portions of the steel strip 9 and pickup W2 adhered to the edge 91 of the steel strip 9 as viewed in FIG. 5. The ratio of edge overcoat was computed from the following equation. Lower ratios than 5% were judged to be acceptable. The equation follows;

ratio of edge overcoat $P=(W2-W1)/W1\times100(\%)$.

After detailed researches and experiments were further conducted as to the length L, the following surprising facts were found.

First, in case of a clearance C that was relatively small, say 4 mm, operation was effected by varying the dimension L. In Comparative Example 4 in which L was as small as 10 mm, the ratio of edge overcoat was acceptably small. However, because the gas jet port 71 of the edge wiping nozzle 7 was too close to the face gas impingement area A, splash frequently adhered to and deposited on the inside of the piping for the edge wiping nozzle 7, i.e., along the edge 91 of the steel strip 9, adversely affecting operation.

In Present Embodiments 5 to 9 in which L was controlled within the range from 15 to 30 mm, the above-described problem of splash was almost completely avoided.

Conversely, Comparative Examples 10 and 11 in which L was as large as 40 mm were ineffective regardless of the arrangement of the edge wiping nozzle 7. It was impossible to prevent splash from depositing on the baffle plate 6 and to prevent molten zinc from growing in bridge-like form between the baffle plate 6 and the edge 91 of the steel strip 9. Besides and unfavorably, these two comparative examples were responsible for inconvenient operation, with too high a ratio of edge overcoat and inadequate product quality.

When the clearance C was relatively large, say 7 mm, Comparative Examples 12 and 13 in which L was as small as 5 mm were almost satisfactory in respect of the ratio of edge overcoat. But, since the gas jet port 71 of the edge wiping nozzle 7 was too near to the gas impingement point A as in Comparative Example 4, splash frequently developed and adhered to and became deposited on the inside of the piping for the edge wiping nozzle 7, i.e., along the edge 91 of the steel strip 9, making it inconvenient to carry out the operation.

In Present Embodiments 14 to 19 in which L was controlled to be as large as 8 to 25 mm, the splashing problem was substantially completely overcome.

Conversely, Comparative Examples 20 and 21 in which L was as large as 30 mm were ineffective even by re-positioning of the edge wiping nozzle 7. It was incapable of preventing splash from deposition on the baffle plate 6 and also of preventing molten zinc from growing in bridge-like form between the baffle plate 6 and the edge 91 of the steel strip 9, as in Comparative Examples 10 and 11. This also resulted in inconvenient operation, too high a ratio of edge overcoat and inadequate product quality.

In Comparative Examples 22 to 26 in which the clearance C was beyond 7 mm, the ratio of gas jet pressure became lower at the edge 91 of the steel strip 9 than at the central portion of the strip 9, even if a powerful edge wiping nozzle was supplied. (Comparative Examples 25 and 26). Thus, molten metal could not be sufficiently wiped out with consequent failure to prevent heavy edge overcoat. It was also found that though the baffle plate 6 was spaced apart from the edge 91 of the steel strip 9, splash tended to adhere to and deposit on the baffle plate 6 in some cases.

As a consequence of the foregoing research results, the relationship between the clearance C and the dimension L has been defined by the equation (1) given above. When this relationship is satisfied, edge overcoat can be prevented to such an extent as to obtain good product quality, and operation can be effected without involving inconvenient splash or inadequate quality.

Figure 6:
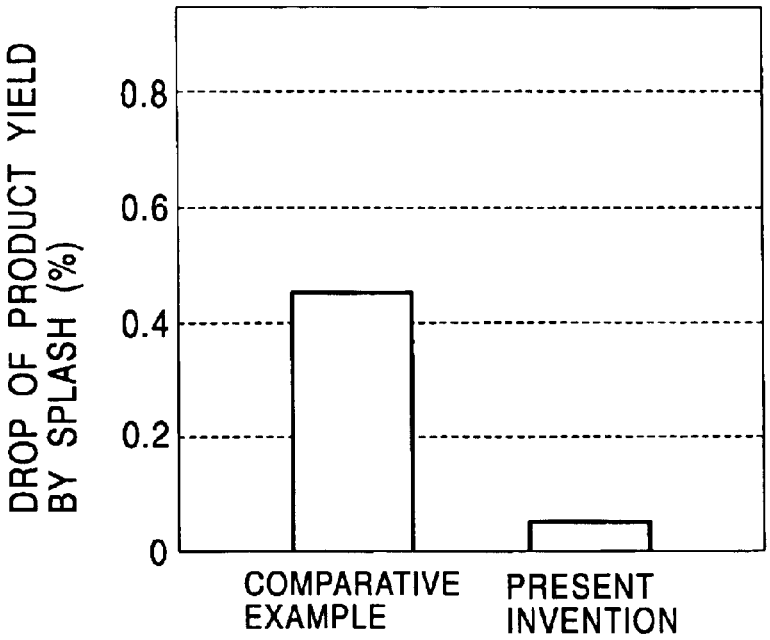
FIG. 6 is a graphical representation of the loss ratios of product yield by splash according to the invention against comparative examples.

FIG. 6 shows the drop ratios of product yield due to splash. The examples satisfying the equation (1) (according to the present invention) were compared to examples failing to meet such equation (the comparative examples). Other conditions were the same in the two types of examples. As evidenced by FIG. 6, the examples of the invention have surprisingly been found to provide a significant increase of about 0.4% in product yield as compared to the comparative examples.

Figure 7:
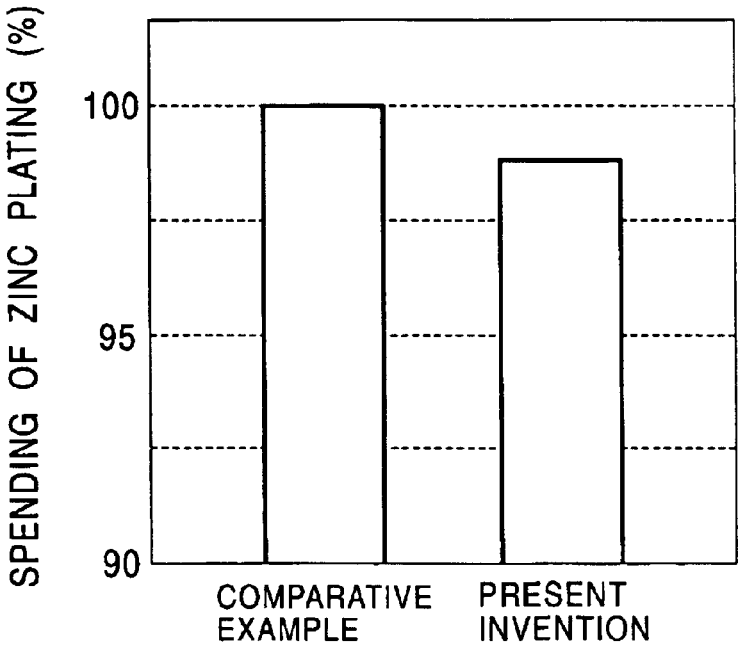
FIG. 7 is a graphical representation of the consumption quantities of zinc plating according to the invention against comparative examples.
Figure 8:
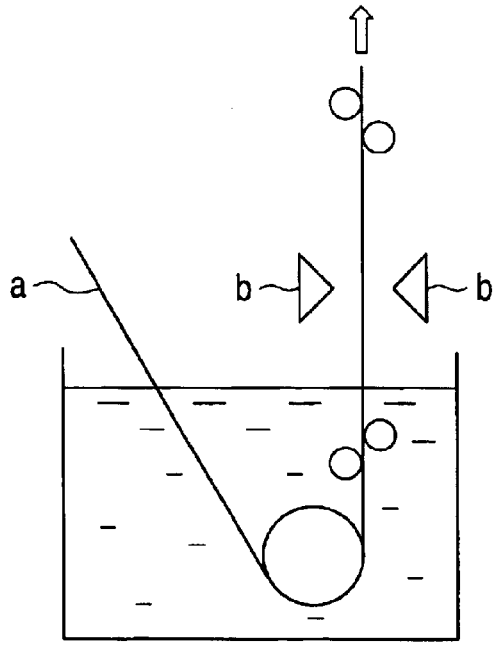
FIG. 8 PRIOR ART
FIG. 8 is a schematic view explanatory of a conventional gas wiping apparatus.
Figure 9:
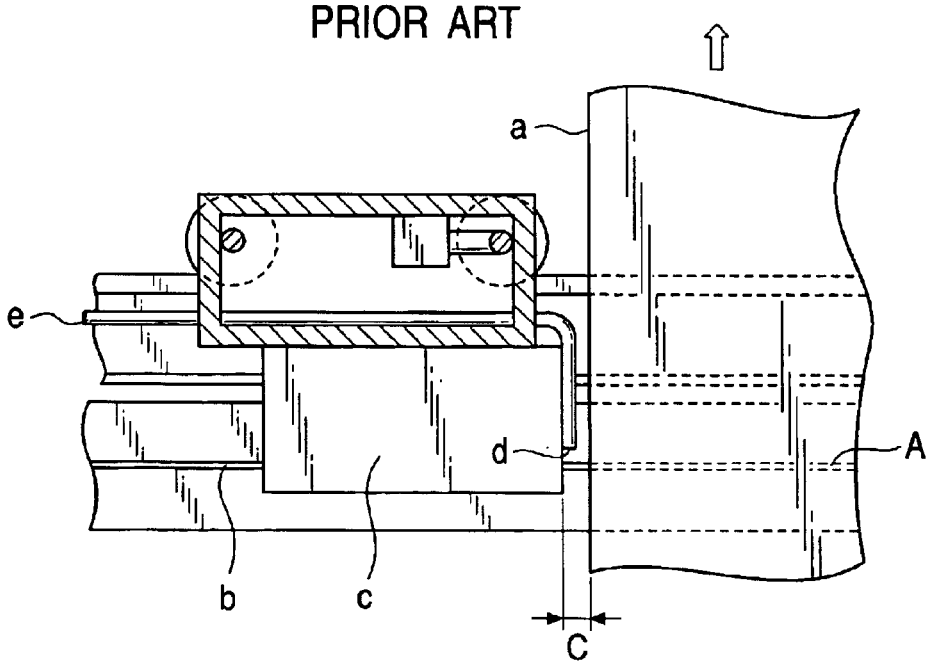
FIG. 9 PRIOR ART
FIG. 9 is a schematic view, also explanatory of a conventional gas wiping apparatus as shown in Japanese Publication No. 1-208441.

FIG. 7 shows the relative consumed quantities of molten zinc, in which examples within the scope of the equation (1) (according to the present invention) were compared to examples outside such equation (the comparative examples). Other conditions were the same in the two types of examples. From FIG. 7, it has been found that due to reduced ratio of edge overcoat, the examples of the invention produced a very significant saving of about 1% in molten zinc consumption as compared to the comparative examples.

As stated and shown hereinabove, the present invention is significantly effective in preventing edge overcoat and splash.

It will accordingly be appreciated that remarkably improved wiped strip product can be achieved in this invention by controlling the values and relationships of the dimensions L and C, and that it is important to provide accurate apparatus for adjusting the position of the edge-wiper toward and away from the strip edge and for adjusting the distance from the edge wiping jet opening toward and away from the area that is being wiped by the face-wiping jets, all in the processing of strip products of different widths.

Instead of the specific apparatus shown and described herein, various equivalent adjusting means such as calipers, screws and other mounting means may be used, all within the spirit and scope of the invention as defined in the appended claims.

What is claimed is:

1. A gas wiping apparatus comprising:

face gas wiping nozzles extending widthwise of a strip material lifted from a liquid bath and caused to travel continuously upwardly along a jet treatment path, said strip having front and back surfaces and side edges, said strip carrying bath liquid on its surfaces by pickup from said bath, said face gas wiping nozzles being adjacent to said jet treatment path and being directed to jet gases onto said front and back surfaces of said strip material, and being aimed at an impingement area on said front and back surfaces of said strip material, thereby limiting the pickup of said bath liquid carried by said front and back surfaces of said strip material;

a pair of baffle plates spaced from said edges of said strip material and in a position adjacent to said gas impingement area; said baffle plates having a distance C from said edges of said strip material;

edge wiping nozzles disposed between each of said baffle plates at its inner edge and adjacent an edge of said strip material, each said edge wiping nozzle being provided with an edge wiping gas jet port positioned adjacent said gas impingement area, each said edge wiping nozzle being positioned for jetting a gas in a widthwise direction relative to said strip material and substantially parallel to each adjacent edge of said strip material;

a drive means for driving said baffle plate and edge wiping nozzles to adjustably move said baffle plate and edge wiping nozzle toward and away from said strip material; and a controller for controlling said drive means to maintain said distance C between said edge of said strip material and said inner edge of said baffle plate within the range from 4 to 7 mm such that when the distance measured along the lifting movement of said strip material between said gas jet port of said edge wiping nozzle and said gas impingement point of said face wiping jet is expressed as L (mm), the relationship between said dimension L and said distance C (mm) satisfies the following equation:

$$-2.0C+20 \leqq L \leqq -2.5C+45.$$

2. A gas wiping apparatus according to claim 1, wherein said edge wiping nozzle is integrally fixed to said baffle plate.

3. Gas wiping apparatus for wiping a moving metal strip having two opposed faces and two opposed edges, comprising:

(a) slit jet gas nozzles adjacent to and aimed at both of said opposed faces at a designated area on said metal strip, (b) edge jet nozzles aimed at and adjacent to both said opposed edges, (c) a pair of spaced-apart baffle plates adjacent each of said edge jet nozzles, and spaced from an adjacent edge of said strip such that said edge jet nozzles are spaced, along the path of travel of said moving metal strip, from said designated area by a distance L, (d) a drive means for driving said baffle plate and edge wiping nozzles to adjustably move said baffle plate and edge wiping nozzle toward and away from said strip material, and (e) a controller for controlling said drive means to maintain said jet nozzles such that each are spaced from the adjacent edge of said metal strip at a distance C which is 4 to 7 mm, and maintain the relationship between said distances L and C in millimeters to satisfy the equation:

$$-2.0C+20 \leqq L \leqq -2.5C+45.$$

4. The apparatus defined in claim 3, wherein when C is 7, L is 6–27.5 and when C is 4, L is 12–35.

5. A gas wiping apparatus comprising:

face gas wiping nozzles extending widthwise of a strip material lifted from a liquid bath and caused to travel continuously upwardly along a jet treatment path, said strip having front and back surface and side edges, said strip carrying bath liquid on its surfaces by pickup from said bath, said face gas wiping nozzles being adjacent to said jet treatment path and being directed to jet gases onto said front and back surfaces of said strip material, and being aimed at an impingement area on said front and back surfaces of said strip material, thereby limiting the pickup of said bath liquid carried by said front and back surfaces of said strip material;

a pair of baffle plates spaced from said edges of said strip material and in a position adjacent to said gas impingement area; said baffle plates being separated from said edges of said strip material by a distance C;

edge wiping nozzles disposed between each of said baffle plates at its inner edge and adjacent an edge of said strip material, each said edge wiping nozzle being provided with an edge wiping gas jet port positioned adjacent said gas impingement area, each said edge wiping nozzle being integrally fixed to said baffle plate and positioned for jetting a gas in a widthwise direction relative to said strip material and substantially parallel to each adjacent edge of said strip material;

drive means for driving either one or both of said baffle plate and said edge wiping nozzle such that the same are adjustably movable toward and away from said strip material; and control means for controlling said drive means to maintain in a preset range the distance C between either one or both of said baffle plate and said edge wiping nozzle, and said edge of said strip material, wherein said distance C between said edge of said strip material and said inner edge of said baffle plate is within the range from 4 to 7 mm;

when the distance measured along the lifting movement of said strip material between said gas jet port of said edge wiping nozzle and said gas impingement point of said face wiping jet is expressed as L (mm), the relationship between said dimension L and said distance C (mm) satisfies the following equation:

$$-2.0C+20 \leqq L \leqq -2.5C+45.$$

6. A gas wiping apparatus comprising:

face gas wiping nozzles extending widthwise of a strip material lifted from a liquid bath and caused to travel continuously upwardly along a jet treatment path, said strip having front and back surfaces and side edges, said strip carrying bath liquid on its surfaces by pickup from said bath, said face gas wiping nozzles being adjacent to said jet treatment path and being directed to jet gases onto said front and back surfaces of said strip material, and being aimed at an impingement area on said front and back surfaces of said strip material, thereby limiting the pickup of said bath liquid carried by said front and back surfaces of said strip material;

a pair of baffle plates spaced from said edges of said strip material and in a position adjacent to said gas impingement area; said baffle plates being separated from said edges of said strip material by a distance C;

edge wiping nozzles disposed between each of said baffle plates at its inner edge and adjacent an edge of said strip material, each said edge wiping nozzle being provided with an edge wiping gas jet port positioned adjacent said gas impingement area, each said edge wiping nozzle being positioned for jetting a gas in a widthwise direction relative to said strip material and substantially parallel to each adjacent edge of said strip material;

drive means for driving either one or both of said baffle plate and said edge wiping nozzle such that the same are adjustably movable toward and away from said strip material; and control means for controlling said drive means to maintain in a preset range the distance C between either one or both of said baffle plate and said edge wiping nozzle, and said edge of said strip material, wherein said distance C between said edge of said strip material and said inner edge of said baffle plate is within the range from 4 to 7 mm; and when the distance measured along the lifting movement of said strip material between said gas jet port of said edge wiping nozzle and said gas impingement point of said face wiping jet is expressed as L (mm), the relationship between said dimension L and said distance C (mm) satisfies the following equation:

$$-2.0C+20 \leqq L \leqq -2.5C+45.$$

* * * * *